United States Patent [19]

Drapeau

[11] 4,101,855

[45] Jul. 18, 1978

[54] MINIATURE RELAY

[75] Inventor: Donald R. Drapeau, Windsor, Conn.

[73] Assignee: Hi-G Incorporated, Windsor Locks, Conn.

[21] Appl. No.: 739,210

[22] Filed: Nov. 5, 1976

[51] Int. Cl.[2] ..... H01H 50/02

[52] U.S. Cl. ..... 335/106; 335/128; 335/202; 335/203

[58] Field of Search ..... 335/106, 128, 202, 203

[56] References Cited

U.S. PATENT DOCUMENTS

| | | | |
|---|---|---|---|
| 3,255,327 | 6/1966 | Wood, Jr. | 335/124 |
| 3,681,722 | 8/1972 | Johnsen et al. | 335/202 |
| 3,694,777 | 9/1972 | Müller | 335/128 |
| 3,705,368 | 12/1972 | Williams Jr. | 335/203 |
| 3,708,768 | 6/1971 | Pratt | 335/203 |
| 3,911,383 | 10/1975 | Tabei et al. | 335/128 |

*Primary Examiner*—Harold Broome

*Attorney, Agent, or Firm*—Prutzman, Hayes, Kalb & Chilton

[57] ABSTRACT

A miniature relay having an electromagnet assembly including a coil carried by a magnetic frame member which assembly is supported on a non-magnetic coil support member which in turn is secured to a header containing an arrangement of stationary and movable contacts and terminal pins. The magnetic frame member includes a core extending through and slightly beyond the coil and a pole piece outwardly adjacent the coil. An armature is held in position by the cooperation of spaced-apart holding elements depending from the electromagnet assembly which saddle a recess area in the armature, and a return spring carried by the header continuously urges the armature into saddle defined by the holding elements. The pull-in force of the electromagnet is enhanced by a mating tab and notch configuration of the pole piece and armature or by an end portion of the pole piece disposed to present increased surface area facing the armature.

30 Claims, 18 Drawing Figures

MINIATURE RELAY

BACKGROUND OF THE INVENTION

This invention relates to a relay structure and more particularly to an improved miniature relay of simplified construction.

Miniature electromagnetic relays are in constant demand as a result of the advanced degree of miniaturization which has developed in the electronics arts. There is need to provide a miniature relay of low cost having a structure which allows simplified assembly. At the same time, it would be highly desirable to provide a miniature relay having improved operating efficiencies, reliable operation and long life.

SUMMARY OF THE INVENTION

The principal object of this invention is to provide an improved miniature relay.

It is a further object of this invention to provide an improved miniature relay having a simplified construction which is relatively easy to assemble and is low in cost.

It is a further object of this invention to provide a miniature relay having an improved magnetic circuit.

It is a further object of this invention to provide a miniature relay having improved operating efficiencies.

It is a further object of this invention to provide a miniature relay of rugged construction which is reliable in operation and has a long wear life.

The present invention provides a miniature relay comprising an electromagnet assembly including a coil carried by a magnetic frame, the electromagnet being fixed to a supporting member of non-magnetic material which, in turn, is fixed to a header containing an assembly of stationary and movable contact members electrically coupled to terminal pins extending through the header. The magnetic frame includes a core portion extending longitudinally through and beyond the coil and terminating in an end facing the header, and the frame also includes a pole piece portion operatively associated with the coil. An armature is held in position by cooperation between a pair of spaced-apart holding elements extending from the electromagnet assembly and a portion of the armature shaped and dimensioned to fit in the region between the holding elements. The spaced-apart holding elements provide a saddle for the armature portion, and the armature is continuously urged into that saddle by biasing means carried by the header. The pull in force of the electromagnet can be enhanced by a mating tab and notch configuration in cooperating portions of the armature and pole piece or by a pole piece end portion disposed to present increased surface area to the armature.

The invention accordingly consists in the features of construction, combination of elements and arrangement of parts which will be exemplified in the construction hereafter set forth and the scope of the application which will be indicated in the appended claims.

BRIEF DESCRIPTION OF THE DRAWING FIGURES

DETAILED DESCRIPTION OF THE ILLUSTRATED EMBODIMENTS

Figure 1:
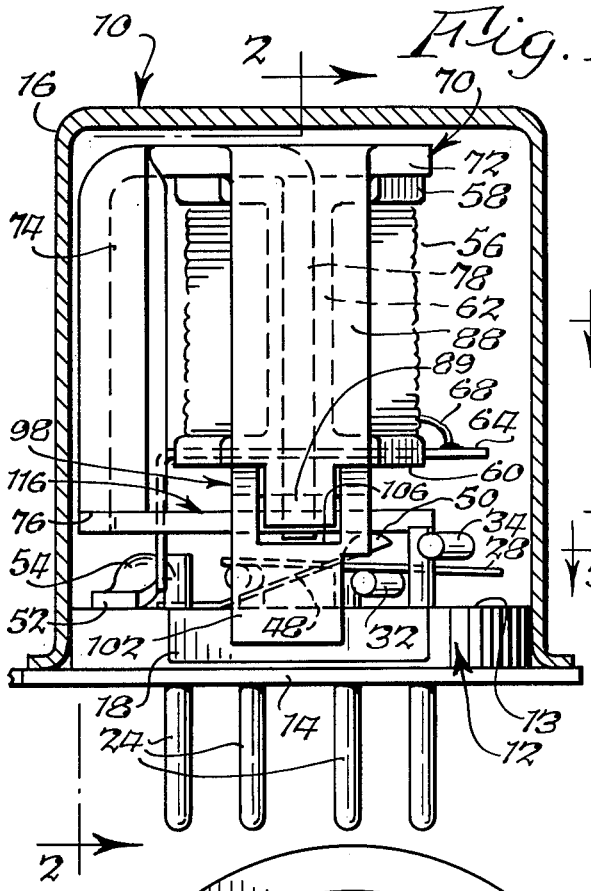
FIG. 1 is an elevational view of a miniature relay according to the present invention with the casing shown in section.

In basic miniature relay structures a coil is carried by a frame of magnetic material which includes a pole piece portion. The electromagnet assembly including coil and frame is mounted on a support header which includes current-carrying terminal pins extending therethrough, at least one pair of fixed contact members each coupled to a corresponding one of the terminal pins and located on one side of the header facing the coil and frame assembly and a movable contact member carried by the header, electrically coupled to another one of the terminal pins, movable between the fixed contact members and normally engaging one of the fixed contacts. An armature is movably mounted in the structure and located between the header and coil and frame assembly with a portion of the armature spaced from the frame pole piece portion to define an air gap. In response to energization of the coil, the armature is moved to close the air gap and complete a magnetic circuit including the coil core, the armature and the magnetic frame. Movement of the armature is applied to the movable contact member placing it in engagement with the other fixed contact.

In accordance with this invention, the magnetic frame includes a core portion extending longitudinally through and beyond the coil and terminating in an end facing the header. The frame also includes a pole piece portion operatively associated with the coil and which can terminate in a pole face disposed toward the header or an end portion disposed at about a right angle to the body of the pole piece portion. The magnetic frame is fixed to a bridge-like supporting member of non-magnetic material which, in turn, is fixed to the header, and the frame core portion extends through and beyond an opening provided in the supporting member. The armature is held in position by cooperation between a pair of spaced-apart holding elements extending from the electromagnet assembly and a portion of the armature shaped and dimensioned to fit in the open region between the holding elements. The holding elements can comprise spaced-apart extensions on the end of the magnetic frame core portion or, alternatively, spaced-apart posts having ball-shaped ends and depending from an insulative bobbin containing the coil. The region between the holding elements provides a saddle for the armature portion, and the armature is continuously urged into that saddle by biasing means in the form of a leaf-spring carried by the header. The pull-in force of the electromagnet can be enhanced by a mating tab and notch configuration in the cooperating portions of the armature and pole piece or by having the angularly disposed end portion of the pole piece present increased surface to the armature.

Referring to the drawings, the miniature relay 10 comprises several principal assemblies or elements including a motor assembly which comprises a coil mounted between a magnetic frame and a non-magnetic support, an armature assembly, and a header assembly which contains switch contact elements and terminal pins on a supporting base.

In the relay structure shown, the header 12 is formed of metal having a platform surface 13 of generally circular configuration with the header serving as a supporting base for the components. A peripheral flange 14 cooperates with the lower flange portion of a casing or cover 16 which is suitably attached to the header as by soldering or welding after assembly of the components thereby hermetically sealing the relay structure. The peripheral surface of header 12 is provided with diametrically-opposed flats 18, 20 which are mutually parallel and disposed perpendicular to the header surface 13. The flat surfaces 18, 20 define right-angle shoulders which facilitate mounting of other components of the relay structure on header 12. A guide tab 22 extends laterally from the peripheral flange portion 14 and serves as a reference indicator for plug mounting or wiring of the relay in a known manner. A plurality of current carrying terminal pins 24 project through apertures provided in header 12 and are secured by fused glass (not shown) which also provides both electrical insulation and a fluid-tight seal between header 12 and each pin 24.

Figure 2:
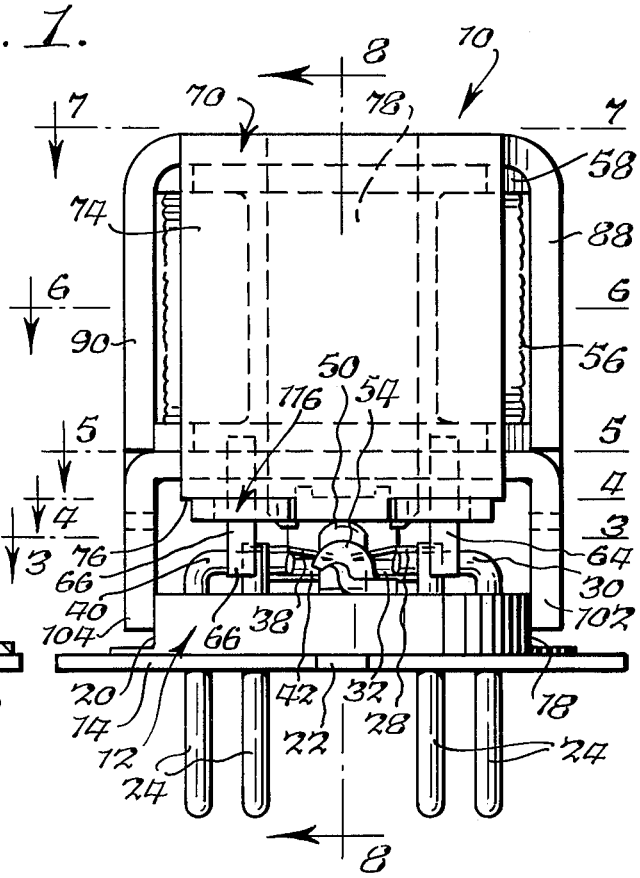
FIG. 2 is an elevational view, with the casing removed, taken along lines 2—2 in FIG. 1.
Figure 3:
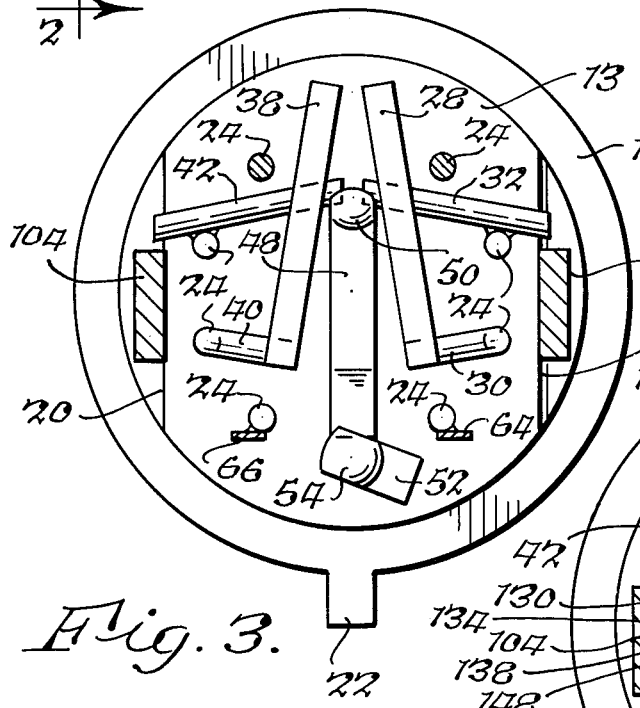
FIG. 3 is a horizontal sectional view taken along lines 3—3 in FIG. 2.
Figure 4:
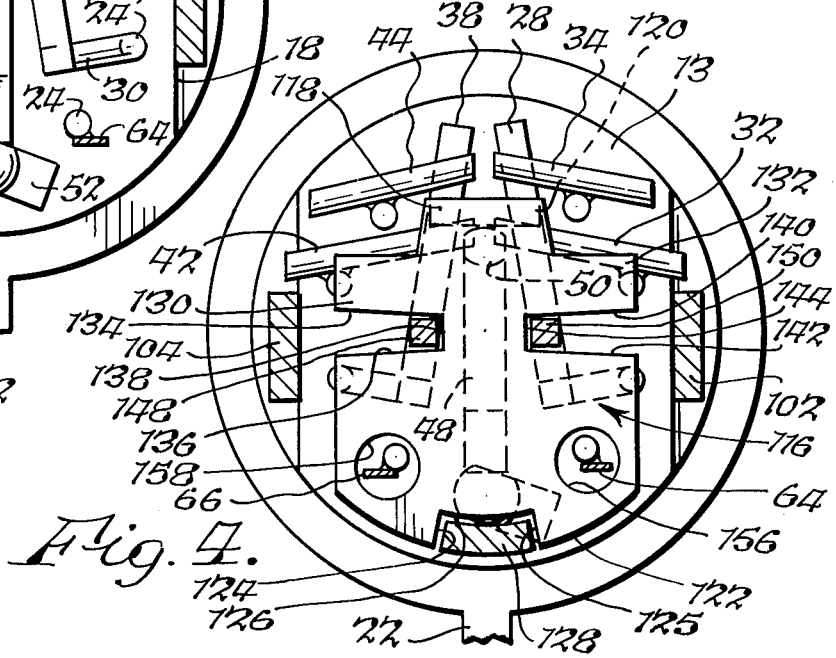
FIG. 4 is a horizontal sectional view taken along lines 4—4 in FIG. 2.

The contact assembly includes a first movable contact member or switch blade 28 carried by header 12 and electrically coupled to one of the terminal pins 24. As shown in FIGS. 2 and 3 a terminal pin 24 has an extended portion 30 which is bent or formed at about a right angle to the pin axis and extends inwardly in spaced parallel relation to the surface of header 12. Switch blade 28, which is in the form of a thin metal strip, is welded at one end to terminal portion 30 and extends at about a right angle to portion 30 as viewed in FIG. 3. The opposite or free end portion of switch blade 28 terminates slightly within the periphery of header surface 13 and is movable between a pair of fixed or stationary contact members 32 and 34 each electrically coupled to a corresponding one of the terminal pins 24. In particular, contact members 32, 34 are in the form of short, relatively straight wire segments, for example silver wire, each having a diameter substantially equal to that of each terminal pin 24, and each contact member 32, 34 is joined as by welding to a corresponding terminal pin about midway along the wire segment and is disposed substantially perpendicular to the corresponding terminal pin. As shown in FIGS. 1, 3 and 4 the terminal pin to which contact member 34 is welded extends a relatively greater distance from header surface 13 with the result that contact members 32, 34 are in spaced relation to accommodate movement of switch blade 28 therebetween. In the relay structure shown, the fixed contacts are generally mutually parallel, generally parallel to header surface 13 and are located within one quadrant of the circle described by the periphery of surface 13.

Figure 10:
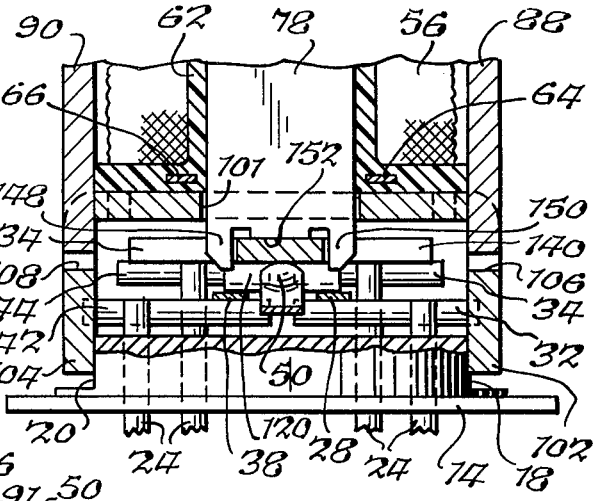
FIG. 10 is a sectional view taken along lines 10—10 in FIG. 9.
Figure 9:
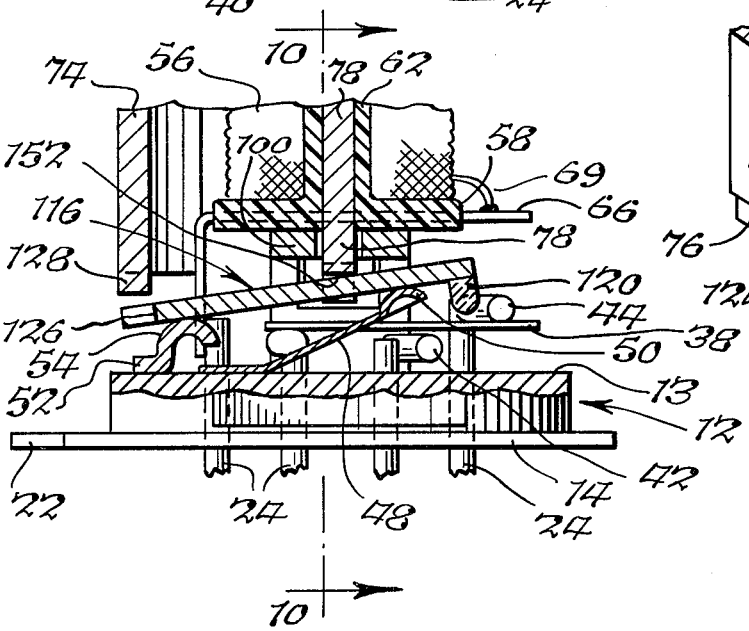
FIG. 9 is a fragmentary vertical sectional view similar to FIG. 8 and showing the armature in a de-energized position.

The assembly of movable contact 28 and fixed contacts 32, 34 is located within one-half of the header surface 13. The relay structure shown includes a similar assembly on the other half of the header surface 13 including a second movable contact member or switch blade 38 welded at one end to an inwardly extending portion 40 of a terminal pin and which has a free end movable between another pair of fixed or stationary contact members 42 and 44. The latter are in the form of relatively straight wire segments, for example silver wire, welded to corresponding terminal pins 24 and located in spaced, generally mutual parallel relation similar to the stationary contacts 32, 34. The arrangement of switch blade 38 and fixed contacts 42, 44 on one half of header surface 13 is a mirror-image of the arrangement of switch blade 28 and fixed contacts 32, 34 on the other half of the surface. In the relay structure shown, the lower stationary contacts 32 and 42 are generally coplanar and spaced-apart, and the upper stationary contacts 34 and 44 also are coplanar and spaced-apart. The movable contact members 28 and 38 are coplanar and, when the relay is de-energized the movable contacts 28 and 38 engage the upper stationary contact members 34 and 44, respectively as shown in FIGS. 9 and 10. The metal strips 28, 38 have resiliency which preloads the strips against the stationary contact members. By way of example, switch blades 28, 38 can be strips of beryllium-copper alloy to provide resiliency coated with silver on the upper and lower surfaces. When the relay is energized, the armature is operated to move the switch blades 28 and 38 simultaneously into engagement with the lower stationary contact members 32 and 42, respectively, as shown in FIGS. 1 and 2.

A biasing means in the form of a leaf spring member 48 is supported by header 12 and operatively engages the relay armature. Spring member 48 is in the form of an elongated strip of spring metal formed to include an end tab portion which is fixed as by welding to header surface 13, an intermediate portion which is inclined with respect to header 12 and an enlargement 50 at the opposite and which has a rounded surface adapted to contact the relay armature. Spring 48 is disposed generally diametrically with respect to header 12 and is positioned between the movable switch blade members 28 and 38 with enlargement 50 located adjacent the fixed contact members. Spring 48 preferably is coated with Teflon or other high surface lubricity material to reduce friction between the spring member and relay armature to increase operating efficiency.

A metal stop element 52 is fixed as by welding to header surface 13 adjacent the end tab of spring 48 and includes an elevated and curved portion 54 defining a rounded surface for contacting the armature to support it in the denergized position. The curved portion 54 can be bent toward and away from header surface 13 by using a miniature screwdriver and pliers to adjust the stop and thereby change the rest or denergized position of the relay armature.

Figure 6:
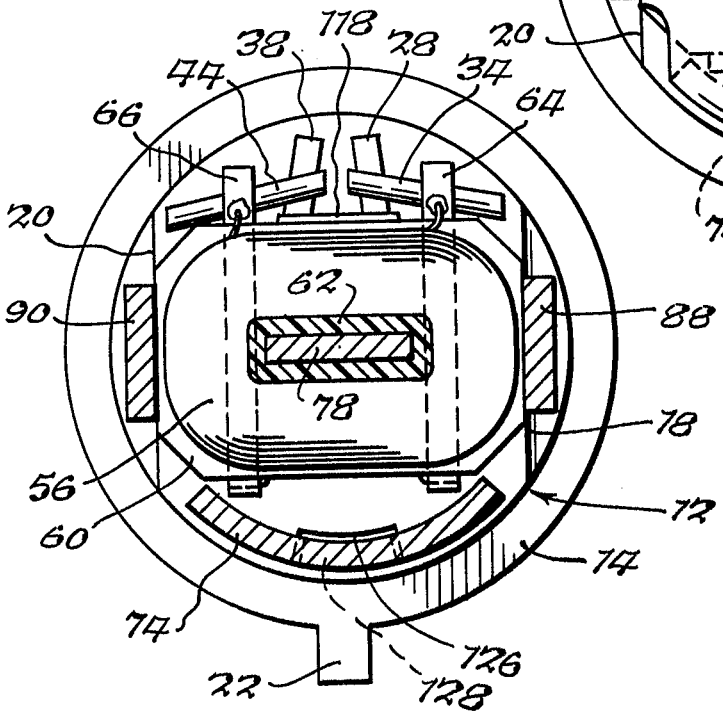
FIG. 6 is a horizontal sectional view taken along lines 6—6 in FIG. 2.
Figure 8:
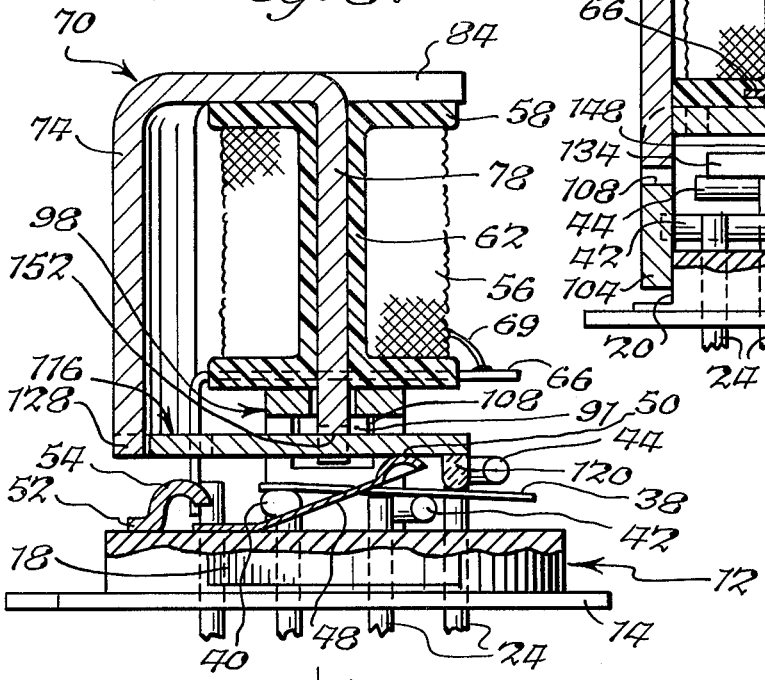
FIG. 8 is a vertical sectional view of the relay shown in FIG. 1.

The motor assembly includes a wire coil 56 wound on a bobbin of insulative material which includes spaced-apart end flanges 58, 60 joined by a core section 62 as shown in further detail in FIG. 8. In the relay structure shown, ends 58, 60 are of generally rectangular configuration and core 62 defines a rectangular opening extending along the longitudinal axis of the coil as shown also in FIG. 6. The coil is positioned in the relay structure with the longitudinal axis of the coil substantially perpendicular to the header surface 13. A pair of conductive ribbons or strips 64, 66 are molded in the end flange 60 nearest header 12 and are in spaced-apart generally parallel relation. A coil lead 68 is welded or soldered to the end portion of ribbon 64 extending from flange 60 near the coil as shown in FIG. 1, and a return lead 69 is soldered or welded to the end portion of strip 66 as shown in FIG. 8. The opposite end portions of ribbons 64, 66 extending from flange 60 are bent or formed to extend generally perpendicular to flange 60 and extend through openings provided in the relay armature and are welded to terminal pins 24. Thus, current is delivered through ribbon 64 and lead 68 to excite the winding 56 and operate the relay.

Figure 7:
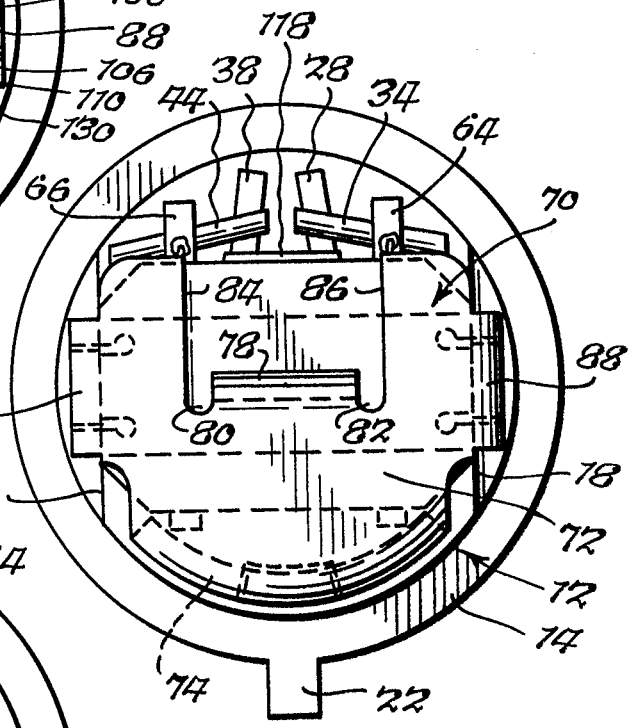
FIG. 7 is plan view taken along lines 7—7 in FIG. 2.

A magnetic frame 70 includes an end portion 72, a pole portion 74 operatively associated with coil 56 defining a magnetic pole face 76 and a core portion 78 extending axially through the coil opening and beyond the coil. Frame 70 is ferromagnetic material and formed with pole portion 74 being of arcuate cross-section and extending in generally orthogonal relation to end portion 72. Pole portion 74 is of considerable arcuate length, extending along substantially one side of the coil 56, and also is of a dimension measured parallel to the axis of coil 56 such that end portion 72 is adjacent one axial end of coil 56 and pole face 76 is located axially beyond the opposite end of coil 56. Core portion 78 is of rectangular cross-section and also extends in generally orthogonal relation to end portion 72 and terminates in an end surface located beyond the coil. Frame 70 is formed by metal stamping and forming techniques facilitated by notches 80, 82 adjacent the bend between core portion 78 and end portion 72 shown in FIG. 7. The width of core portion 78 is less than the corresponding dimension of frame end portion 72, and an open area is defined in the end portion by a pair of spaced-apart, generally parallel edges 84, 86 shown in FIG. 7 which extend inwardly to notches 80, 82. Frame 70 also includes a pair of spaced, parallel legs 88 and 90 extending at right angles to end portion 72 in the same direction as pole 74 and core 78 and terminating in tab portions 89 and 91, respectively, shown in FIGS. 1 and 9. Legs 88 and 90 are located in a somewhat straddling relation to core 78. Furthermore, the mutually parallel planes in which legs 88, 90 are disposed are substantially perpendicular to the plane of core portion 78.

Figure 5:
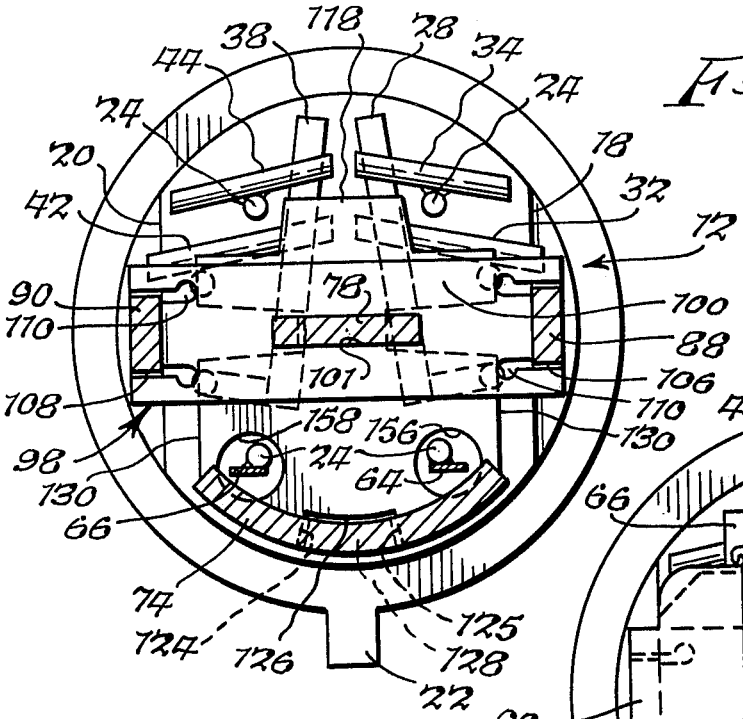
FIG. 5 is a horizontal sectional view taken along lines 5—5 in FIG. 2.

A support element 98 of non-magnetic material such as brass or aluminum supports coil 56 and magnetic frame 70 on header 12 in spaced relation to surface 13. Support element 98 includes a base portion 100 which is generally rectangular in shape having an opening 101 located generally centrally thereof and further includes a pair of leg portions 102 and 104 extending from opposite ends of base portion 100 at right angles thereto and in the same direction. Support element 98 is formed to include a pair of openings 106 and 108 adjacent the junctures between legs 102, 104 and base portion 100 and extending along the legs as shown in FIGS. 1 and 8. Support element 98 is formed by metal stamping and bending operations which are facilitated by the notches 110 adjacent the bends as shown in FIG. 5.

During assembly of the relay, legs 102 and 104 of support 98 are welded to flats 18 and 20, respectively, of header 12 as shown in FIGS. 1 and 2. Legs 88 and 90 of frame 70 are welded to support 98 with tabs 89 and 91 being received in openings 106 and 108, respectively, of support 100 to facilitate assembly and alignment as well as provide added structural rigidity. Coil 56 is supported with end flange 60 contacting base portion 100 of the support. The frame core portion 78 extends through opening 101 in base 100 in relatively close fitting relation which holds core 78 firmly in position against lateral movement. The foregoing arrangement provides a simple vertical alignment of the relay components which affords simplified assembly.

An armature 116 is located in spaced relation to header 12 and is in the form of a planar, plate-like body of ferro-magnetic material having a first portion or end tab 118 provided with an operator element 120 of insulative material for operatively engaging the movable contacts or switch blades 28, 38 as shown in FIGS. 8 and 9. The elongated element 120 is of sufficient length to bridge both movable contacts 28, 38 and is fixed in a suitable manner to the lower surface of armature tab 118. The opposite end of armature 116 has a curved or arcuate edge 122 of substantially the same curvature as pole piece 76. In the relay structure shown, the edge 122 is provided with an inwardly extending notch or recess including spaced-apart side edges 124, 125 joined by an inner, arcuate edge 126, and this notch receives a tab 128 extending from pole piece 74, in particular depending from pole face 76, the tab and notch being in relatively closely-fitting relation. When the relay is de-energized, the portion of armature 116 adjacent edge 122 is spaced a small distance from pole face 76 to define an air gap, and the air gap includes the gap or space along the mating tab and notch configuration.

The armature 116 has opposite side edges 130 and 132 which are substantially parallel and which join the opposite ends of the armature as shown in FIG. 4. A first inwardly extending recess or slot is defined by a pair of edges 134, 136 extending in from edge 130 which meet an inner end surface 138. Edges 134, 136 diverge slightly outwardly from surface 138. A second inwardly extending recess or slot is aligned with the first slot and is defined by a pair of edges 140, 142 extending inwardly from edge 132 which meet an inner end surface 144. Edges 140, 142 diverge slightly outwardly from surface 144. The inner end surfaces 138 and 144 are substantially parallel and define therebetween a recessed area or portion of the armature.

Core 78 of magnetic frame 70 terminates in an end surface having an elongated recessed region defined therein between a pair of spaced-apart, depending extensions or ears 148 and 150 as shown in FIGS. 4 and 10. The recessed or open region extends in a direction generally perpendicular to the longitudinal axis of coil 56.

The distance between the armature notch inner end surfaces 138 and 144 allows the region of armature 116 therebetween to be received in the recessed region between the extending ears 148 and 150 of core 78 in a manner such that the two ears 148, 150 provide a saddle-like region for the armature portion. The armature is continously urged into that saddle by the action of leaf spring 48 the rounded enlargement 50 thereof contacting the lower surface of armature 116 adjacent end tab 118. The foregoing arrangement permits limited angular movement of armature 116 about or relative to the region between ears 148, 150 along a plane parallel to the longitudinal axis of coil 56. In the relay structure shown, armature 116 moves along a plane perpendicular to the length of the region defined between extensions 148, 150. The region between extensions 148, 150 is generally rectangular in shape and includes a planar inner surface 152 disposed substantially perpendicular to the longitudinal axis of core 78. The inner surface of extensions 148, 150 are disposed substantially perpendicular to surface 152. The length of the region between extension 148, 150 is several times greater than the width, the width in turn is equal to the thickness of core 78 at the end surface thereof, and angular movement of armature 116 is in a plane substantially perpendicular to the length of the region between extensions 148, 150.

Armature 116 is provided with apertures 156, 158 shown in FIG. 5 laterally spaced and adjacent edge portion 122 through which the conductive ribbons 64 and 66, respectively, extending from coil flange 60 are fed or directed to corresponding terminals 24 to which the ribbons are welded.

The relay structure is assembled in the following manner. After assembly of header 12 is completed, including terminal pins 24, movable contacts 28, 38, fixed contacts 32, 34 and 42, 44, leaf spring 48 and stop 52, the motor assembly including coil 56 and frame 70 is fixed to supporting element 98 by assembly and welding as previously described. Then this combination is fixed to header 12 by welding legs 102, 104 to header 12 as described. Then armature 116 is assembled in position with the area or portion between edges 138, 144 placed in the saddle-like region between core extensions 148, 150 and held therein by leaf spring 48. As shown in FIG. 9, when coil 56 is not energized, the lower surface of armature 116 adjacent edge 122 contacts the curved portion 54 of the stop, the armature upper surface between edges 138, 144 contacts the edge of core surface 152 facing the end 118 of the armature, and the armature is held or maintained in this inclined position with respect to header surface 13 by spring 48 which contacts the lower surface of armature 116 adjacent end tab 118.

Figure 11:
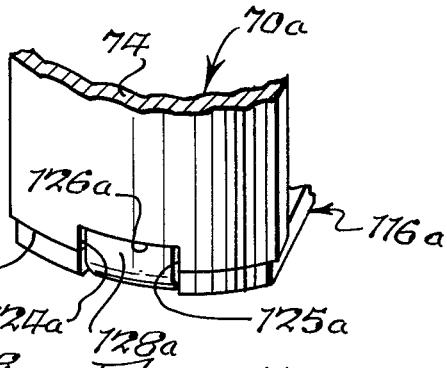
FIG. 11 is a fragmentary sectional view of an alternative configurating of the cooperating armature and pole piece portions.
Figure 12:
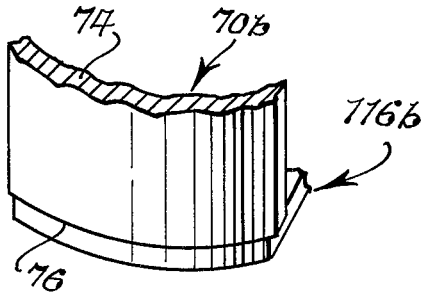
FIG. 12 is a fragmentary sectional view of another form of the armature and pole piece portions.

FIG. 11 shows an alternative arrangement of the mating notch and tab configuration between armature and pole wherein pole 74 of a magnetic frame **70*a* is provided with a notch or recess extending inwardly from pole face 76 and including spaced-apart substantially parallel side edges 124*a*, 125*a* which meet an inner edge 126*a* disposed substantially parallel to pole face 76. An armature 116*a* is provided with a tab 128*a* extending from the arcuate end thereof into the pole recess. FIG. 12 shows a portion of the armature and pole of a relay structure having an armature 116*b* which terminates in a smooth continuous arcuate end surface which cooperates with a smooth, continuous pole face 76 of a frame 70*b***.

In the de-energized condition of the relay, the movable contacts 28 and 38 are preloaded against the normally closed stationary contacts 34 and 44, respectively, and the armature 116 is biased against the stop 52 by the return spring 48. Therefore, the electrical path in this position is from the normally closed stationary contacts 34 and 44 through the movable contacts 28 and 38, respectively, each circuit being independent of one another. In this condition, the circuits including normally open contacts 32, 42 are electrically inoperative.

With the application of electrical power through the appropriate terminal pins 24 and coil leads to coil 56, the coil is energized causing armature 116 to be magnetically attracted to frame 70. This magnetic force overcomes the biasing force of leaf spring 48 and the preloading of movable contacts 28, 38 and causes armature 116 through operator element 120 to move the switch blades 28 and 38 from the normally closed contacts 34 and 44, respectively, into engagement with the normally open contacts 32 and 42, respectively. In this position, an electrical signal can be transmitted from the normally open contacts 32 and 42 through the movable contacts 28 and 38, respectively. During this operation armature 116 moves about the recessed region between core extensions 148, 150 with the edge of surface 152 previously described serving as a fulcrum in contact with the armature surface. After a small degree of angular movement the armature 116 comes to rest with the upper surface adjacent edge 122 contacting pole face 76. In the foregoing position, the electrical circuits including normally closed contacts 34, 44 are electrically inoperative. When the electrical potential to coil 56 is removed, armature 116 loses magnetic attraction to frame 70 and is moved to the initial or rest position by action of leaf spring 48 and the resiliency of switch blades 28, 38.

FIGS. 13 - 16 show a miniature relay according to another embodiment of this invention. The header and contact assembly is identical to that of the embodiment of FIGS. 1-10. Briefly, and referring to FIG. 14, a metal header generally designated 164 has a platform surface 165, and the header carries a plurality of current carrying terminal pins 166 which project through apertures in header 164 and are secured by fused glass (not shown). A movable contact member or switch blade 168 in the form of a thin strip of resilient metal is carried by header 164 and electrically coupled such as by being welded at one end to one of the terminal pins in a manner similar to the arrangement of FIGS. 1-10. The opposite or free end portion of switch blade 168 is movable between a pair of spaced-apart, fixed or stationary contact members 170 and 172 in the form of metal wire segments each electrically coupled to a corresponding one of the terminal pins 166 such as by welding. As in the embodiment of FIGS. 1-10, the foregoing assembly of movable contact 168 and fixed contacts 170, 172 is located within one-half of the header surface 165, and a similar assembly of movable contact and fixed contacts is located within the other half of the header surface. A biasing means in the form of a metal leaf spring member 174 is supported by header 164 and operatively engages the relay armature. An adjustable metal stop element 176 is fixed to header surface 165 and establishes the rest or deenergized position of the relay armature. Spring member 174 and stop element 176 are identical in structure, location and operation to spring member 48 and stop element 52, respectively, of the embodiment of FIGS. 1-10.

Figure 13:
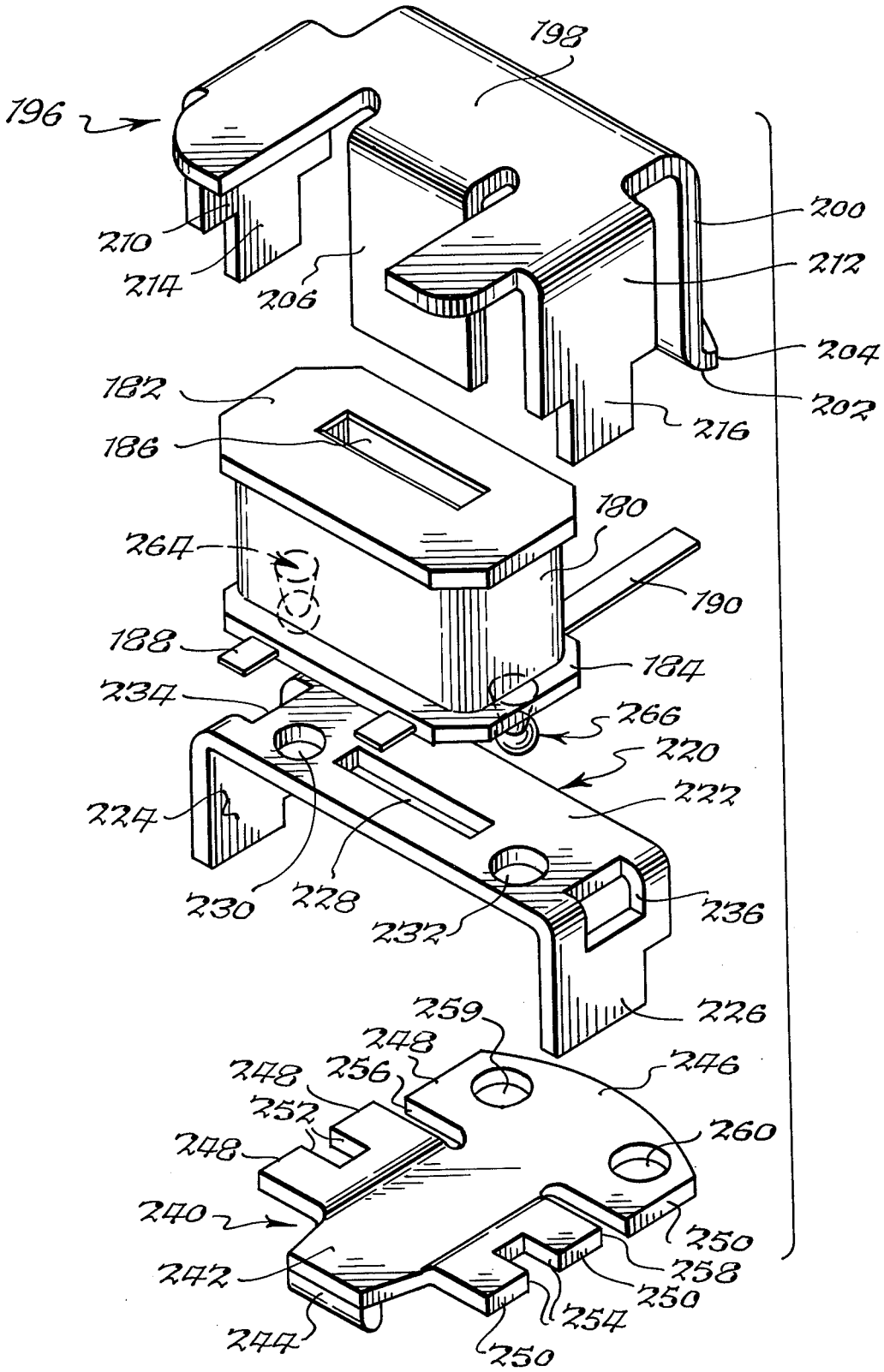
FIG. 13 is an exploded, perspective view with parts removed of a miniature relay according to another embodiment of the present invention.
Figure 14:
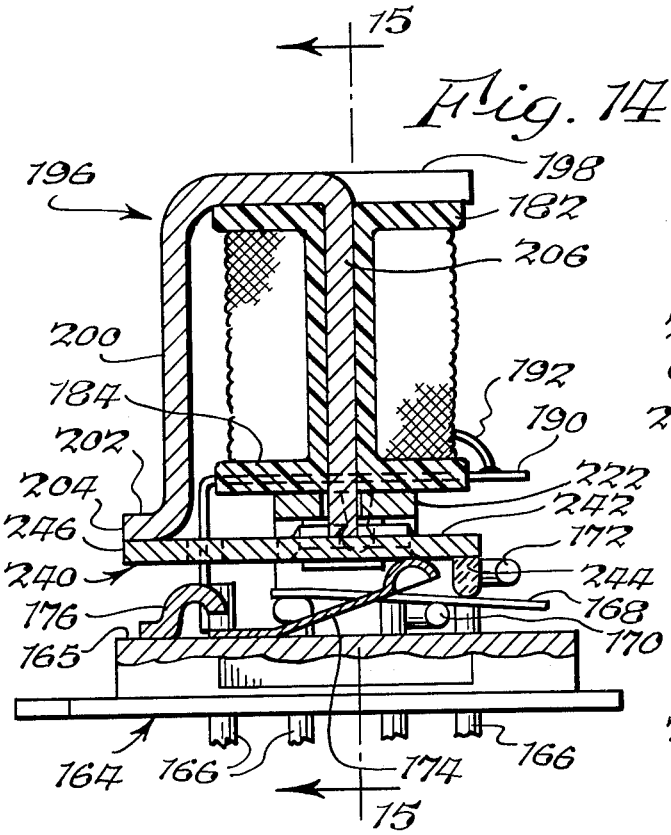
FIG. 14 is a vertical sectional view showing the relay of FIG. 13.
Figure 16:
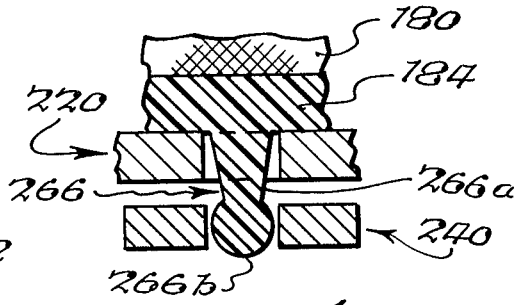
FIG. 16 is a sectional view taken along lines 16—16 in FIG. 15.

The motor assembly includes a wire coil 180 wound on a bobbin of insulative material which includes spaced-apart end flanges 182, 184 joined by a core section 186 as shown in further detail in FIG. 13. In the relay structure shown, ends 182, 184 are of generally rectangular configuration, core 186 defines a rectangular opening extending along the longitudinal axis of the coil, and the coil is positioned in the relay structure with the longitudinal axis thereof substantially perpendicular to header surface 165. A pair of conductive ribbons or strips 188, 190 are molded in the end flange 184 nearest header 164 and are in spaced-apart generally parallel relation. A coil lead 192 is welded or soldered to the end of ribbon 190 as shown in FIG. 14 and a return lead (not shown) is similarly connected to ribbon 188. The opposite end portions of ribbons 188, 190 extend through openings provided in the relay armature and are welded to terminal pins 166 as in the embodiment of FIGS. 1–10. Thus, current is delivered through ribbon 190 and lead 192 to excite the relay.

A magnetic frame 196 includes a generally planar end portion 198, a pole piece operatively associated with coil 180 and comprising a main body portion 200 and an end portion 202 which terminates in an arcuate end face 204, and a core portion 206 extending axially through the coil opening and beyond the coil where it terminates in a planar end face 208. Frame 196 is of ferromagnetic material and formed with the pole piece main body portion 200 being generally planar and extending in generally orthogonal relation to end portion 198. The pole piece main body portion 200 is of considerable width, extending along substantially one side of the coil 180, and also is of a length measured parallel to the axis of coil 180 such that frame end 198 is adjacent one axial end of coil 180 and pole piece end portion 202 is located axially beyond the opposite end of coil 180. Core 206 is of rectangular cross-section and also extends in generally orthogonal relation to end portion 198 and terminates in end surface 208 located beyond the coil. End face is rectangular and disposed in a plane generally perpendicular to the axis of coil 180. Frame 196 is formed by metal stamping and forming techniques similar to frame 70 of the embodiment of FIGS. 1–10. Frame 196 also includes a pair of spaced, parallel legs 210 and 212 extending at right angles to end portion 198 and terminating in tab portions 214 and 216, respectively. Legs 210 and 212 are located in a somewhat straddling relation to core 206, and the mutually parallel planes in which legs 210, 212 are disposed are substantially perpendicular to the plane of core portion 206.

A support element 220 of non-magnetic material such as brass or aluminum supports coil 180 and magnetic frame 196 on header 164 in spaced relation to surface 165. The support element includes a generally rectangular base portion 222 and a pair of leg portions 224, 226 extending in the same direction from opposite ends of base 222 and at right angles thereto. An elongated, rectangular opening 228 is provided in base 222 generally centrally thereof, a pair of openings 230, 232 are provided between the ends of the central opening and corresponding ones of the legs 224, 226 which openings preferably are circular in shape, and a pair of generally rectangular openings 234 and 236 are provided at the junctures between base 222 and legs 224 and 226, respectively, which openings extend along the upper portions of the legs as shown in FIG. 13.

An armature 240 is located in spaced relation to header 164 and is in the form of a generally planar, plate-like body of ferromagnetic material having a first portion or end tab 242 provided with an operator element 244 of insulative material fixed to the lower surface of tab 242 and of sufficient length for operatively engaging both the movable switch blade elements as in the embodiment of FIGS. 1–10. The opposite end of armature 240 has a smooth, continuous curved or arcuate edge 246, and surface 204 of pole piece end portion 202 has substantially the same curvature as edge 246. When the relay is deenergized, the portion of armature 240 adjacent edge 246 is spaced a small distance from pole piece end portion 202 to define an air gap.

The armature 240 has substantially parallel opposite side edges 248, 250 joining the opposite ends thereof, and first and second rectangular shaped recesses or slots 252 and 254 extend inwardly from edges 248 and 250, respectively. The two slots are substantially perpendicular to the corresponding side edges, are aligned, and the inner end surfaces or edges of the slots are substantially parallel and define therebetween an armature recessed area or portion of reduced lateral dimension. The armature also has a pair of relatively narrow elongated slots 256, 258 extending inwardly from edges 248, 250 at locations between corresponding ones of the recesses 252, 254 and the arcuate edge 246. Slots 256, 258 are generally perpendicular to the side edges, are aligned and extend inwardly a slightly greater distance than the corresponding recesses 252, 254. The provision of slots 256, 258 permits the regions containing recesses 252, 254 to be formed slightly out of the plane of the remainder of the armature for a purpose which will be described. In the relay structure shown, the plane of the armature upper surface is disposed about mid-way of the thickness of the two raised portions. A pair of openings 259, 260 are located near edge 246 for receiving the depending portions of the coil ribbons 188, 190.

Figure 15:
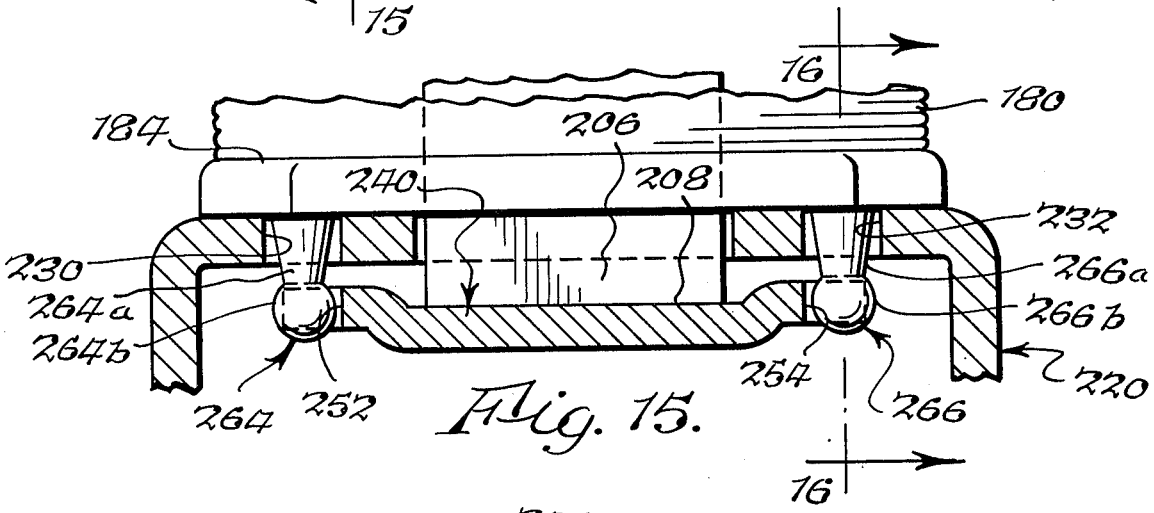
FIG. 15 is a fragmentary sectional view taken along lines 15—15 in FIG. 14.

A pair of armature holding elements 264 and 266 extend in spaced-apart relation from the electromagnet assembly, in particular from end flange 184 of the coil bobbin, and define an elongated open region therebetween. Holding elements 264, 266 are located adjacent and inwardly of opposite ends of the rectangular flange 184 and are located so that the elongated open region therebetween is disposed perpendicular to the longitudinal axis of coil 180 and parallel to the elongated end surface 208 of core 206. Holding elements 264, 266 are disposed in mutually parallel relation and are perpendicular to end flange 184. Holding elements or posts 264, 266 are of non-magnetic material and preferably are molded or otherwise formed integrally with the coil bobbin. In the relay structure shown each holding element has a generally frusto-conical body portion **264*a*, 266*a* with the larger diameter end adjacent flange 184 and each element terminates in a generally ball-shaped or substantially spherical formation 264*b*, 266*b*. As shown in FIG. 15, holding elements 264, 266 are of the same overall length, and the diameter of the spherical end portion is substantially equal to the diameter of the base of the conical portion. The posts 264 and 266 extend through the openings 230 and 232, respectively, in supporting element 220**.

The distance between the inner end surfaces of the armature notches 252 and 254 allows the region of armature 240 to be received in the elongated open region between the holding elements 264 and 266 in a manner such that the two post elements 264, 266 provide a saddle-like region for the armature portion. The armature is continuously urged into that saddle by the action of leaf spring 174, the rounded enlargement thereof contacting the lower surface of armature 240 adjacent end tab 242. The foregoing arrangement provides limited angular movement of armature 240 about or relative to the region between posts 264, 266 along a plane which is substantially parallel to the longitudinal axis of coil 180 and substantially perpendicular to the length of the region between posts 264, 266 and to core end surface 208. The upper surface of armature 240 between the raised surface portions including slots 252, 254 contacts the edge of core end surface 208 facing armature end tab 242, and the armature moves about this edge when it closes the air gap as shown in FIG. 14. The ball-like ends **264*b*, 266*b* of the post elements have only point contact with surfaces of the armature slots 252, 254 thereby minimizing mechanical friction. The ends 264*b*, 266*b* of the posts co-operate with the armature 240 in a manner analogous to a ball bearing mount. The post elements 264, 266 are spaced from opposite ends of the core surface 208, and the centers of the spherical ends 264*b*, 266*b* of the post elements are located on a line which is coincident with the edge of core end surface 208 about which the armature moves. As armature 240 moves about this edge, the movement is along a plane disposed between posts 264, 266 and, in particular, along a plane parallel to the longitudinal axes of the posts. The armature portions containing slots 252, 254 are formed to be offset or raised slightly from the remainder of the armature permitting the surfaces of the slots 252, 254 to encompass the post spherical ends 264*b*, 266*b* while the edge of core surface 208 contacts the armature surface and is aligned with the centers of the post ends 264*b*, 266*b***.

Having posts 264, 266 of non-magnetic material such as nylon and the like prevents any magnetic attraction between the armature and the posts which might otherwise influence the desired armature movement. Providing posts 264, 266 integral with bobbin flange 184 simplifies assembly and lowers cost. The entire core end surface 208 is planar thereby increasing the amount of mating surface area between armature and core which, in turn, increases the amount of magnetic force generated by coil 180. This provides more available force for actuating the relay and increases the efficiency of the relay magnetic path. The central points between the post ends **264*b*, 266*b* and armature 240 are relatively near the armature side edges 248, 250**. This outboard location of the contact points together with proper manufacturing tolerances decreases radial slop or play in the armature thereby enhancing consistency and reliability of relay operation.

The pole piece end portion 202 provides a turned or folded over frame pad of increases surface area which faces the end of armature 240 adjacent the arcuate end 246. In particular, end portion 202 is disposed at about a right angle to main body portion 200 and extends outwardly away from coil 180. The disposition of end portion 202 presents a surface toward armature 240 which is greater in area than the cross-section of main body portion 200. This increases the efficiency of the magnetic assembly and provides more force for actuating the relay.

Figure 17:
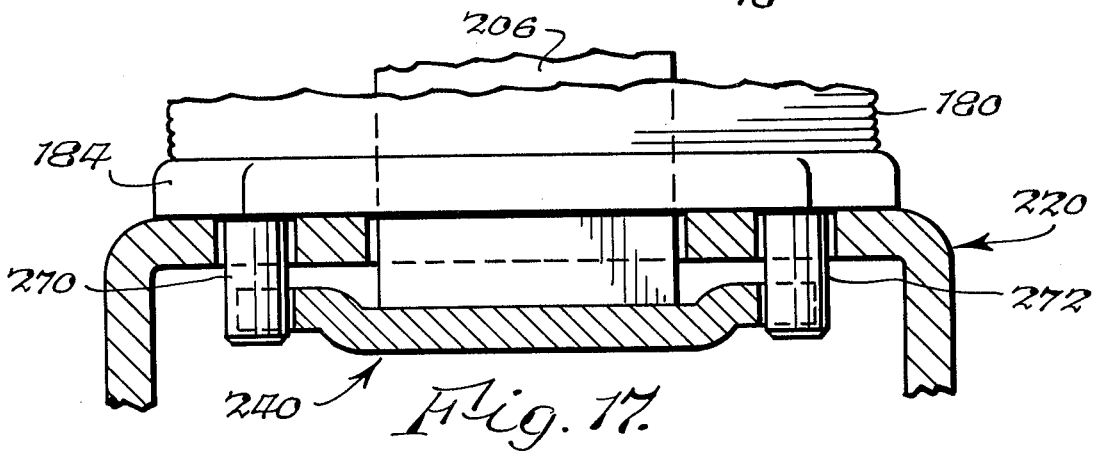
FIG. 17 is a sectional view similar to FIG. 15 showing an alternative form of armature holding elements.

As alternative armature holding elements, FIG. 17 shows cylindrical post elements 270, 272 of non-magnetic material depending from coil bobbin flange 184 at the same locations as posts 266, 264. The cylindrical posts 270, 272 can be of nylon or like non-magnetic material, and the posts have line contact with corresponding surfaces of the armature notches 252, 254 in a direction parallel to the longitudinal axes of posts 270, 272.

Figure 18:
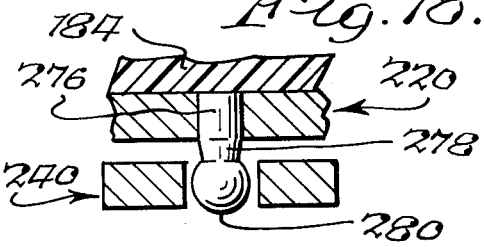
FIG. 18 is a sectional view similar to FIG. 16 showing an alternative form of armature holding element.

As a further alternative, the armature holding elements can comprise a pair of posts extending from the supporting element 220. The posts are of non-magnetic material such as brass or nylon and are located in spaced relation within legs 224, 226 and depend from the lower surface of base 222. As shown in FIG. 18, each post has a cylindrical body portion 278 fixed in an opening in base 222, a generally frusto-conical intermediate portion 278 and a ball-like spherical end 280. The posts can be of the same metal, i.e. brass or aluminum, as supporting element 220 but preferably one of nylon and pressed into openings in base 222. The location of such openings can be identical to that of openings 230, 232 shown in FIG. 13.

The relay structure is assembled in a manner similar to the embodiment of FIGS. 1–10. After assembly of the various parts on header 164, the motor assembly including coil 180 and frame 196 is fixed to supporting element 220 with posts 264 and 266 extending through openings 230 and 232, respectively. Then this sub-assembly is fixed to header 164 by welding legs 224, 226 thereto. Armature 240 is assembled in position with the area or portion between the inner edges of notches 252, 254 placed in the saddle-like region between posts 264, 266 and held therein by leaf spring 174. A can or housing (not shown) is attached to header 165 after assembly of the parts to seal the relay structure as in the embodiment of FIGS. 1–10. The stacked, vertical arrangement of components provides ease in assembly and thus lowers manufacturing cost.

When coil 180 is not energized, the lower surface of armature 240 adjacent edge 246 contacts the curved portion of the stop 176, the armature upper surface between recesses 252, 254 contacts the edge of core surface 208 facing the end 242 of the armature, and the armature is held or maintained in this inclined position with respect to header surface 165 by spring 174 which contacts the lower surface of armature 240 adjacent end tab 242. With the application of electrical power through the appropriate terminal pins 166 and coil leads to coil 180, the coil is energized causing armature 240 to be magnetically attracted to frame 196 and move to the energized position shown in FIG. 14. The conditions of the electrical circuits including the various relay contacts in the de-energized and energized positions of armature 240 is identical to those of the relay shown in FIGS. 1–10.

From the foregoing description of the structure and operation of the illustrated embodiments of this invention, it is apparent that an improved miniature relay of simplified construction has been provided. The miniature relay of this invention is of low cost employing a simple vertical alignment or stacked relationship of the relay components for simplified assembly thereby to minimize assembly cost while at the same time providing improved relay operating efficiencies. The armature is not secured to the magnetic frame but rather is held in position solely by the cooperation of the spaced-apart holding elements depending from the electromagnet assembly which saddle a recess area in the armature, the armature being continuously urged therein by the armature return spring. The foregoing together with the magnetic frame being of one piece including pole and core which also serves as a support frame for the coil simplifies the structure and assembly of the miniature relay. In addition, having the armature moved about an edge of the magnetic frame, i.e. about the edge of the core end surface, reduces series air gaps in the magnetic path thereby reducing losses in the electromagnetic circuit during initial energization of the relay. Providing the holding elements in the form of posts of non-magnetic material having substantially spherical ends reduces or substantially eliminates mechanical friction and magnetic attraction in an undesired direction which might otherwise impede normal armature movement. The mating tab and notch configuration of the cooperating portions of armature and pole increases the overall extent or length of the magnetic air gap along the armature and pole portions and along the configuration. This gives rise to a so-called motor effect whereby the pull-in force of the electromagnet is enhanced when the coil is energized. Alternatively, having the pole piece end portion disposed at about a right angle to the pole piece main body portion presents increased pole piece area to the armature to enhance the pull-in force of the electromagnet. Providing the bridge-like support element of non-magnetic material prevents loss of magnetic flux through the support and limits the flux path or circuit to include the coil, frame and armature. The provision of conductive ribbons molded in the insulative end flange of the coil bobbin which are fed or directed through apertures in the armature simplifies the making of coil connection during assembly of the relay.

As will be apparent to persons skilled in the art, various modifications and adaptations of the structure above described will become readily apparent without departure from the spirit and scope of the invention the scope of which is defined in the appended claims.

I claim:

1. A miniature relay comprising:

(a) a support header having a plurality of terminal pins extending therethrough:

(b) a pair of fixed contact members each electrically coupled to a corresponding one of said terminal pins and positioned on one side of said header;

(c) a movable contact member carried by said header and electrically coupled to another of said pins, said contact member having a portion movable between said fixed contact members and normally engaging one of said members;

(d) an electromagnet assembly comprising a coil carried by a magnetic frame, said coil having a magnetic core and said frame having a portion operatively associated with said coil and defining a magnetic pole piece;

(e) holding means comprising a pair of spaced-apart holding elements extending in the same direction from said electromagnet assembly and defining an elongated open region therebetween;

(f) means for supporting said coil and magnetic frame on said header in spaced relation to said one side of said header with said holding means facing said header;

(g) an armature located in spaced relation to said header and having a first portion operatively engaging said movable contact, a second portion operatively associated with said pole piece and a third portion shaped and dimensioned to be received in said open region between said holding elements in a manner permitting limited angular movement of said armature relative to said open region along a plane disposed between said holding elements; and (h) biasing means supported by said header and engaging said armature in a manner urging said armature third portion into said open region between said holding elements normally so that said armature first portion allows said movable contact to engage said one of said fixed contact members and said armature second portion is spaced from said pole piece;

(i) whereby in response to electrical energization of said coil said armature second portion is attracted to said pole piece thereby moving said armature against said biasing means causing said first portion to move said movable contact into engagement with the other of said fixed contact members.

2. The miniature relay recited in claim 1 wherein said holding elements are of non-magnetic material.

3. The miniature relay recited in claim 1 wherein each of said holding elements terminates in a substantially spherical formation.

4. The miniature relay recited in claim 1 wherein said coil has an axially extending opening formed therein, wherein said magnetic frame has another portion extending along and through said coil opening defining said magnetic core of said coil, said core terminating in an end beyond said coil, and wherein said holding elements comprise spaced-apart extensions on said end of said core.

5. The miniature relay recited in claim 1 wherein said coil is wound on a bobbin of insulative material having a pair of end flanges, said bobbin being disposed so that one of said end flanges faces said header, and wherein said holding elements extend from said one end flange.

6. The miniature relay recited in claim 5 wherein said holding elements are formed integrally with said bobbin flange and wherein each of said holding elements terminates in a substantially spherical formation.

7. The miniature relay recited in claim 1 wherein said coil has an axially extending opening formed therein, wherein said magnetic frame has another portion extending along and through said coil opening defining said magnetic core of said coil, said core terminating in a planar end face beyond said coil and disposed generally perpendicular to the longitudinal axis of said coil, and wherein said armature holding elements are spaced from opposite ends of said core end face and terminate in substantially spherical formations, the centers of said spherical formations being aligned with an edge of said core end face.

8. The miniature relay recited in claim 1 wherein said armature comprises a generally planar body having said first and second portions adjacent opposite ends thereof and joined by opposite side edges of said body and wherein said third portion is defined by a pair of aligned recesses extending inwardly from said opposite side edges and each recess terminating in an inner edge, said inner edges being spaced apart a distance less than the length of said open region between said armature holding elements.

9. The miniature relay recited in claim 8 wherein said inner edges of said armature recesses are substantially parallel and are disposed substantially perpendicular to the length of said open region between said holding elements, the distance between said armature recess edges providing a relatively close fit of said armature third portion between said holding elements.

10. The miniature relay recited in claim 1 and a notch in said armature second portion and a tab extending from said pole piece of said magnetic frame into said notch in relatively close fitting relation to enhance the pull-in force between said armature and pole piece when said coil is energized.

11. The miniature relay recited in claim 1 and a notch in said pole piece of said magnetic frame and a tab extending from said armature second portion into said notch in relatively close fitting relation to enhance the pull-in force between said armature and pole piece which said coil is energized.

12. The miniature relay recited in claim 1 wherein said magnetic frame pole piece has a main body portion and an end portion, said end portion being disposed at an angle to said main body portion in a manner presenting an increased surface area of said pole piece to said armature.

13. The miniature relay recited in claim 1 wherein said supporting means comprises an element of non-magnetic material fixedly secured to said header and having a portion on which said frame and coil are fixedly carried.

14. The miniature relay recited in claim 1 wherein said magnetic frame includes a pair of spaced-apart legs extending toward said header and wherein said supporting means comprises an element of non-magnetic material having a pair of spaced-apart legs fixed to said header and a planar base portion joining said legs and disposed generally parallel to said header, the ends of said frame legs being fixed to said supporting element adjacent the opposite ends of said planar base portion, said coil being supported on said planar base portion and said core portion of said magnetic frame extending through an opening in said planar base portion.

15. The miniature relay recited in claim 1 wherein said coil is wound on a bobbin of insulative material having a pair of end flanges, and further including a pair of conductive leads each having an intermediate portion embedded in one of said bobbin end flanges, one end of each lead being electrically coupled to said coil and the other end of each lead being electrically coupled to a corresponding one of said terminal pins.

16. The miniature relay recited in claim 15 wherein said leads extend from said bobbin end flange through corresponding apertures in said armature to said terminal pins.

17. The miniature relay recited in claim 1 and a second pair of fixed contact members each electrically coupled to a corresponding one of said terminal pins and positioned on said one side of said header, a second movable contact member carried by said header and electrically coupled to another of said pins having a portion movable between said second pair of fixed contact members and normally engaging one of said members and an operator element of insulative material on said armature and engaging both of said movable contact members for simultaneously moving said movable contact members into engagement with the other of said fixed contact members upon movement of said armature.

18. The miniature relay recited in claim 1 and a stop element having a portion fixed to said header and a portion extending therefrom for engaging said armature to establish the rest position of said armature when said coil is de-energized, said extending portion being curved and adjustable in position toward and away from said header to adjust the rest position of said armature.

19. A motor assembly for a miniature relay comprising:

(a) an electromagnet assembly including a coil having an axial opening therethrough and a magnetic frame operatively associated with said coil and including a pole piece section extending along and outwardly of said coil and terminating adjacent one end of said coil and a core section extending along and through said coil opening and terminating in an end face adjacent the same end of said coil;

(b) a pair of spaced-apart holding elements extending from said electromagnet;

(c) an armature comprising a generally planar magnetic body having a pair of slots extending inwardly from opposite edges of said body and defining a recessed area therebetween, said pair of spaced-apart holding elements extending from said electromagnet defining a saddle for said armature recessed area; and (d) biasing means for continuously urging said armature recessed area into said saddle defined by said holding elements in a manner such that said armature is spaced from said pole piece when said coil is deenergized.

20. The miniature relay motor assembly recited in claim 19 wherein said holding elements comprise spaced-apart extensions on said core end face.

21. The miniature relay motor assembly recited in claim 19 wherein said holding elements are of non-magnetic material.

22. The miniature relay motor assembly recited in claim 21 wherein each of said holding elements terminates in a substantially spherical end portion having point contact with surfaces of the corresponding one of said armature slots.

23. The miniature relay motor assembly recited in claim 22 wherein said armature contacts an edge of said core end face, said holding elements are spaced from opposite ends of said core end face, and the centers of said spherical end portions are aligned with said edge of said core end face.

24. An improved flux path for a miniature relay comprising a coil carried by a magnetic frame having a pole piece terminating in a pole face portion and an armature having a portion spaced a small distance from said pole face portion defining an air gap therebetween when said coil is de-energized, said armature adapted for movement in response to energization of said coil to close said air gap, said pole face portion and said armature portion having a closely-fitting, mating tab and notch configuration which increases the extent of said air gap along said armature and pole face portions to enhance the pull-in force between said armature and pole piece when said coil is energized.

25. An improved flux path for a miniature relay comprising a coil carried by a magnetic frame having a pole piece including a main body portion and an end portion, and an armature having a portion spaced a small distance from said pole piece end portion defining an air gap therebetween when said coil is de-energized, said armature adapted for movement in response to energization of said coil to close said gap, said pole piece end portion being disposed at an angle to said main body portion in a manner such that the area of the pole piece end portion surface facing said armature is greater than the cross-sectional area of said pole piece main body portion thereby enhacing the pull-in force between said armature and pole piece when said coil is energized.

26. A mounting for supporting an electromagnet in a miniature relay, said electromagnet comprising a coil within a magnetic frame including spaced-apart leg members extending therefrom, a supporting base, and a supporting element of non-magnetic material comprising a generally planar body portion and a pair of leg members extending therefrom, said leg portions of said supporting element being fixed to said base, said leg members of said magnetic frame being fixed to said supporting element and said coil being supported on said planar base portion of said supporting element.

27. The miniature relay mounting recited in claim 26 and a pair of spaced-apart armature holding elements extending from said body portion of said supporting element toward said supporting base, said armature holding elements being located between said leg portions of said supporting elements.

28. The miniature relay mounting recited in claim 27 wherein each of said holding elements terminates in a substantially spherical formation.

29. The miniature relay mounting recited in claim 26 wherein said magnetic frame leg members are fixed to said supporting element at locations adjacent the junctures between said planar base portion and said supporting element legs.

30. The miniature relay mounting recited in claim 29 wherein said supporting element is provided with an opening adjacent each juncture between said planar base portion and said leg members and said supporting element is provided with another opening in said planar base portion generally centrally thereof, each of said leg members of said magnetic frame being provided with a tab extending from the end of said leg member which fits in a corresponding one of said supporting element openings, said opening in said base portion receiving a magnetic core extending from said coil.

* * * * *